US005111652A

United States Patent [19]

Andre

[11] Patent Number: 5,111,652

[45] Date of Patent: May 12, 1992

[54] CUTTING JET RECEPTACLE FOR A FLUID JET CUTTING MACHINE

[75] Inventor: Joël R. Andre, Bougival, France

[73] Assignee: Aerospatiale Societe Nationale Industrielle, Paris, France

[21] Appl. No.: 549,768

[22] Filed: Jul. 9, 1990

[30] Foreign Application Priority Data

Jul. 18, 1989 [FR] France ..... 89 09626

[51] Int. Cl.[5] ..... B24C 9/00

[52] U.S. Cl. ..... 51/424; 51/425; 83/53; 83/177

[58] Field of Search ..... 51/410, 424, 425, 439, 51/266; 83/53, 177

[56] References Cited

U.S. PATENT DOCUMENTS 2,985,050 5/1961 Schwacha ..... 51/410
3,164,933 1/1965 Labowsky ..... 51/266
3,996,825 12/1976 Terry .
4,204,448 5/1980 Pearl ..... 83/177
4,435,902 3/1984 Mercer .
4,698,939 10/1987 Hashish ..... 51/410
4,758,284 7/1988 Todd .

FOREIGN PATENT DOCUMENTS 0107573 5/1984 European Pat. Off. .
0207069 12/1986 European Pat. Off. .
0223372 5/1987 European Pat. Off. .

*Primary Examiner*—M. Rachuba

[57] ABSTRACT

In order to receive the cutting jet (20) in a machine to cut a sheet material by a fluid jet, the present invention provides a mobile receptacle (10) in which this jet is destroyed by one or several counter-jets (34) delivered by nozzles (32). The fluids are evacuated by a conduit of pipes (36). This disposition makes it possible to significantly extend the lifetime of the receptacle and authorizes the functioning of the latter regardless of the inclination of the cutting jet (20). Stand-by parts (40, 46) receive the jet or counter-jets in the event of any malfunction. In addition, cooling means (52, 59) make it possible to eliminate the heat and mist formed by the cutting and via the impact of the jets.

11 Claims, 2 Drawing Sheets

CUTTING JET RECEPTACLE FOR A FLUID JET CUTTING MACHINE

FIELD OF THE INVENTION

The invention concerns a cutting jet receptacle to be used on a fluid jet cutting machine.

BACKGROUND OF THE INVENTION

Fluid jet cutting machines have been used for many years to cut materials in sheets, such as plastic materials, paper, leather, rubber, metallic and composite materials formed of woven or non-woven superimposed layers impregnated with resin, etc.

On such machines, cutting of the material is effected by means of one or several nozzles, each delivering a fluid jet usually constituted by a high pressure water jet which, when required to cut metal materials, may often contain abrasive particles. Each jet is transmitted at extremely high speed, which may vary according to the materials to be cut. When the jet has completed its material cutting function, it is received in a receptacle designed in such a way as to absorb the residual energy which remains significant at the outlet of the material.

So as to carry out this function, mobile receptacles are normally used, which move at the same time as the cutting nozzle from the other side of the material to be cut, or fixed receptacles which extend over the entire width of the machine and opposite which the cutting nozzle moves.

In the case of mobile receptacles, the energy of the jet is generally absorbed by an interchangeable expendable part placed in the prolongation of the jet so that the latter strikes this part. The documents DE-A-3 518 166, U.S. Pat. Nos. 4,532,949 and 4,651,476 illustrate receptacles embodied according to this principle. In the document CH-A-567 908, the cutting jet strikes a liquid bath before arriving at the expendable part.

All these mobile receptacles require a large amount of maintenance owing to the presence of interchangeable expendable parts which need to be replaced frequently. Moreover, when a liquid is present above the expendable part, the receptacle may not be used in a slanted position.

As regards fixed receptacles illustrated in particular by the document U.S. Pat. No. 4,501,182, the energy of the jet may be absorbed by a liquid flowing in the bottom of the receptacle. However, in addition to the drawback linked to the spatial requirement of such a device, the latter may only be used in a virtually horizontal position, which excludes it being possible to orientate the cutting jet in a direction moved away from vertical.

In one particular case referred to in the document U.S. Pat. No. 2,985,050, an expendable elastomer material is placed below the liquid used to absorb most of the energy of the jet, and sprinkling ramps, placed below the level of the liquid in the receptacle and directed towards the point of impact of the cutting jet on the liquid, prevent too high a rise of the mist formed by the impact of the jet on the liquid. This device also exhibits the same drawbacks as the preceding device.

SUMMARY OF THE INVENTION

The object of the invention is to embody a mobile type cutting jet receptacle whose original conception enables it to suppress or at least highly minimize the wear of the parts constituting the latter, ensures that less maintenance is required and significantly increases the lifetime of said receptacle and makes it possible for it to be used irrespective of the orientation of the cutting jet, which may then vary between vertical and horizontal.

According to the invention, this result is obtained by means of a cutting jet receptacle for a fluid jet cutting machine, wherein said receptacle includes a hollow body having a cutting jet feed orifice kept in the alignment of this jet, at least one nozzle delivering inside this hollow body a fluid counter-jet along a certain orientation and under a certain pressure so that this counter-jet strikes the cutting jet and destroys it, and means for evacuating the fluid outside the hollow body.

In a receptacle embodied as above, the counter-jet(s) fulfill(s) a function similar to the function of expendable parts and/or the liquid bath in those receptacles of the prior Art. Maintenance is therefore considerably reduced and the receptacle may be used irrespective of the orientation of the cutting jet.

In one preferred embodiment of the invention, the receptacle includes at least two nozzles delivering counter-jets orientated in opposition with respect to the cutting jet traversing said orifice along directions inclined by a given angle with respect to one axis of the latter and distributed at regular intervals around this axis.

This disposition makes it possible to place a stand-by anti-splash plug pellet in the prolongation of the cutting jet above the impact of the latter on the counter-jets, which avoids the receptacle being damaged should a malfunction occur in these jets.

Advantageously, the hollow body is provided with an internal sheathing comprising a stand-by shoulder placed in the prolongation of the counter-jets delivered by the nozzles. This shoulder prevents the receptacle being damaged should a stoppage of the cutting jet occur without interrupting the counter-jets.

So as to eliminate the heat and mist generated by cutting and the impact of the jets inside the receptacle, the hollow body advantageously exhibits on its internal surface encompassing said feed orifice a recess with a semi-toric section extended by a concentration truncated surface situated between the feed orifice and the shoulder formed on the internal sheathing.

Elimination of heat and mist may also be favored by the presence of cooling means of the hollow body. These cooling means may include either a closed cooling circuit partly situated in the hollow body, or an open cooling circuit opening into the hollow body, or cooling ribs formed on the outer surface of the latter.

BRIEF DESCRIPTION OF THE DRAWINGS

There now follows a description of three preferred embodiments of the invention, given by way of example and being in no way restrictive, with reference to the accompanying drawings in which.

DETAILED DESCRIPTION OF THE PREFERRED EMBODIMENTS

Figure 1:
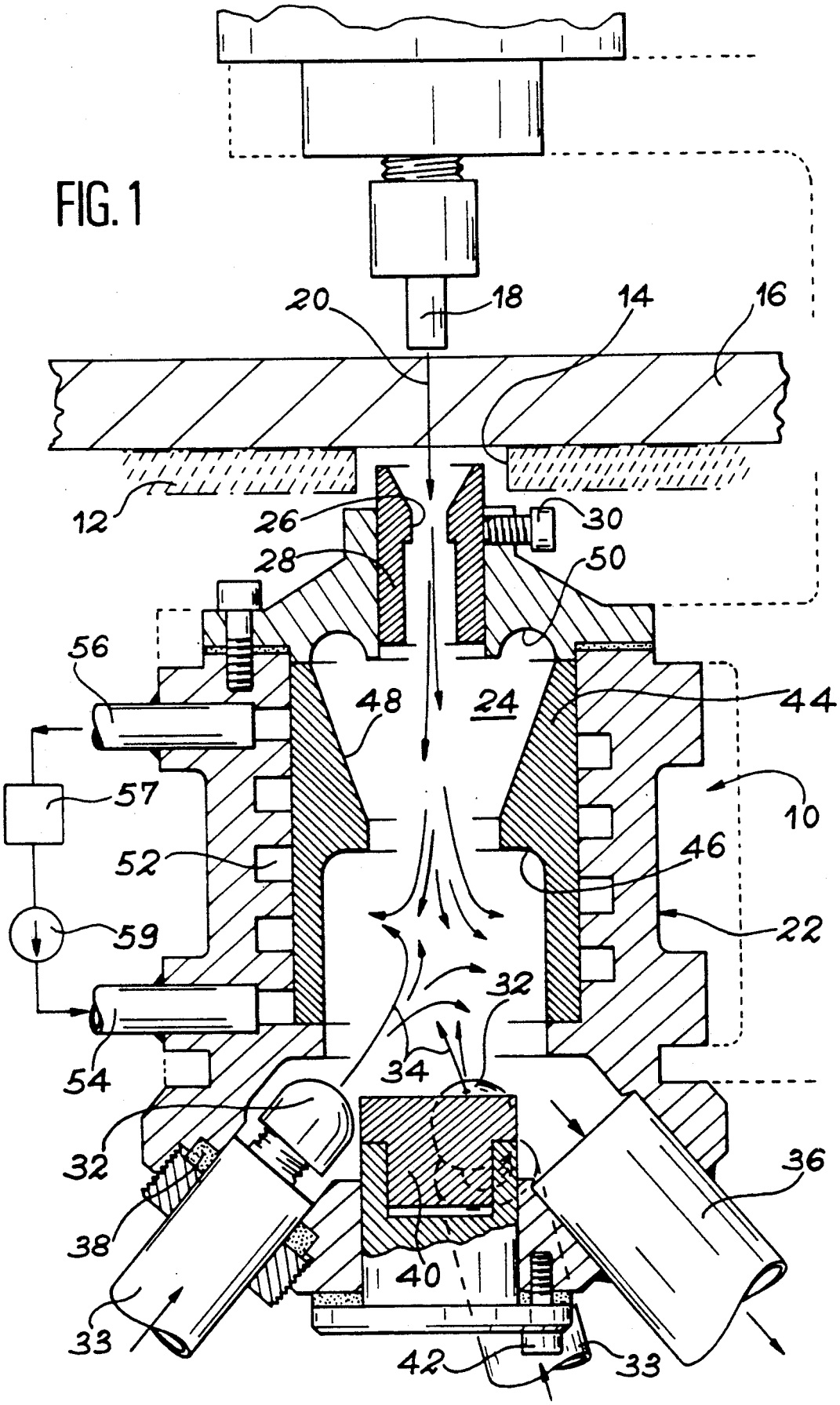
FIG. 1 is a longitudinal cutaway view representing a receptacle according to the invention and installed on a fluid jet cutting machine in the case of a first embodiment of the invention whereby this receptacle is cooled by an independent closed circuit.

On FIG. 1, the reference 10 generally denotes a cutting jet receptacle embodied in accordance with the invention and installed on a fluid jet cutting machine whose disposition may be of any nature, said machine possibly being a manual control machine or a programmable machine. On this machine, the receptacle 10 is placed immediately below an aperture 14 formed in a horizontal table 12 supporting the part to be cut, said part being denoted by the reference 16. Above the part 16 and at the right of the aperture 14, the cutting machine comprises a cutting nozzle 18 opposite which the receptacle 10 is placed. The nozzle 18 and the receptacle 10 have a common axis which is shown vertical on FIG. 1 but whose orientation may possibly vary between vertical and horizontal by virtue of the use of the receptacle 10 of the invention.

The cutting nozzle 18 and the receptacle 10 are mounted on the machine so as to be able to move together opposite the aperture 14 along a generally transversal direction with respect to the machine, this direction being perpendicular to a longitudinal direction corresponding to the movement of the material 16 on the table 12. This simultaneous movement of the nozzle 18 and the receptacle 10 may be obtained by any device and especially by interconnecting these two members by a U-shaped arm laterally overlapping the part 16.

In operation, the cutting nozzle 18 emits a cutting jet 20 constituted by an under high pressure fluid jet which traverses the part 16 and then the aperture 14 before being collected in the receptacle 10. This cutting jet 20 is generally a water jet containing abrasive particles. It is transmitted at a high speed, usually supersonic.

The receptacle 10, in which this jet 20 is collected in accordance with the invention, is now to be described in more detail with reference to FIG. 1.

This receptacle 10 includes a hollow body 22 generally having a symmetry of revolution around an axis merged with the axis of the jet 20. This body 22 delimits an internal chamber 24 into which the jet 20 penetrates via a feed orifice 26 whose axis is also merged with the axis of the jet. This feed orifice 26 is formed in a bush 28 mounted on the body 22 and made of a material having extremely high resistance to abrasion. Adjustment means constituted by a screw 30 make it possible to move the bush 28 along the axis of the body 22 so that one extremity of this bush penetrates inside the aperture 14 and is found immediately close to the part 16 to be cut. The distance separating the bush 28 from the face of the part 16 opposite the cutting nozzle 18 may accordingly be accurately adjusted.

With regard to the direction of movement of the jet 20 inside the bush 28, the passage 26 successively has one approximately truncated convergent zone, one zone of reduced diameter and one zone of larger diameter opening into the internal chamber 24.

In its section situated opposite the bush 28, the body 22 of the receptacle 10 supports three nozzles 32 each transmitting a counter-fluid jet 34 along a direction which cuts the direction of the cutting jet 20 and orientated in the opposite direction with respect to the latter. The fluid transmitted by the nozzles 32 may be water. The pressure of the counter-jets 34 delivered by the nozzles 32 is adjusted by suitable means (not shown) placed in the feed pipes 3 of these nozzles. This adjustment is effected by taking account of the pressure of the cutting jet 20 so that, when the counter-jets strike the cutting jet, the latter is totally destroyed.

Each of the nozzles 32 is secured to the body 22 of the receptacle 10 so as to be able to move by means of a packing box 38 ensuring imperviousness of the chamber 24 with respect to the outside.

More precisely, the axes of the nozzles 32 and of the counter-jets 34 transmitted by these nozzles are orientated in opposition along directions inclined by a given angle of about 45° in the example represented with respect to the axis of the feed orifice 26, that is to the axis of the cutting jet 20. In addition, the three nozzles 32 are distributed at regular intervals around this axis, that is at 120° in relation to each other so that they simultaneously strike the cutting jet 20 and break it completely.

So as to evacuate the residual liquid resulting from the collision of the cutting jet 20 and the counter-jets 34, the body 22 is also imperviously traversed by an evacuation pipe 36 whose axis forms approximately the same angle as that of the nozzles 32 with the axis of the feed orifice 26 and which is disposed roughly between two of these nozzles. This pipe 36 opens into the internal chamber 24 which connects the latter to an effluent evacuation circuit (not shown) not forming part of the present invention.

The cutting nozzle 18 and the nozzles 32 transmitting the counter-jets 34 are normally controlled simultaneously so as to ensure that the cutting jet 20 or the counter-jets 34 do not damage the body 22 of the receptacle.

However, and so as to take into account any possible malfunctioning of the counter-jets 34, a stand-by anti-splash plug pellet 40 is mounted in the chamber 34 opposite the feed orifice 26 and between the nozzles 32, that is beyond the normal point of impact of the counter-jets with the cutting jet. This pellet 40, made of a material with extremely high resistance to abrasion, is placed in the prolongation of the cutting jet 20 so that the latter strikes it if the counter-jets 34 are not functioning properly. The pellet 40 is secured to the body 22 of the receptacle 10 by dismountable fixing means, such as a screw 42, making it possible, if need be, to replace it.

The circumferential surface of the chamber 24 is formed on an internal sheathing 44 of the body 22 made of a material having extremely high resistance to abrasion. This internal sheathing 44 comprises a stand-by shoulder 46 turned towards the nozzles 32 and the pellet 40. This shoulder 46 is localized so that the counter-jets 34 directly strike it in the event of any accidental stoppage of the cutting jet 20.

In the zone between this shoulder 46 and the feed orifice 26, the internal surface of the sheathing 44 comprises a truncated concentration surface 48 whose diameter from the orifice 26 to the shoulder 46 becomes smaller.

In its section encompassing the feed orifice 26, the extremity surface of the chamber 24 comprises a recess 50 with a semi-toric section formed directly in the body 22. This recess 50 extends the truncated concentration surface 48 and has the effect of bringing the mist, generated by cutting of the part and the impact of the jets inside the chamber 24, back to the evacuation pipe 36.

The elimination of this mist is also facilitated by cooling the receptacle 10.

In the embodiment shown on FIG. 1, this cooling is effected by causing a cooling fluid to circulate in a closed circuit, one part of this circuit being situated inside the body 22 of the receptacle. This part of the circuit internal to the body of the receptacle includes a helical groove 52 formed in the body 22 and interiorly delimited by the sheathing 44. The cooling liquid penetrates this groove 52 via a pipe 54 situated close to the nozzles 32 and leaves it via a pipe 56 situated close to the bush 28. Between the pipes 54 and 56, the cooling circuit conventionally includes means 57 to cool the cooling fluid, as well as a pump 59.

Figure 2:
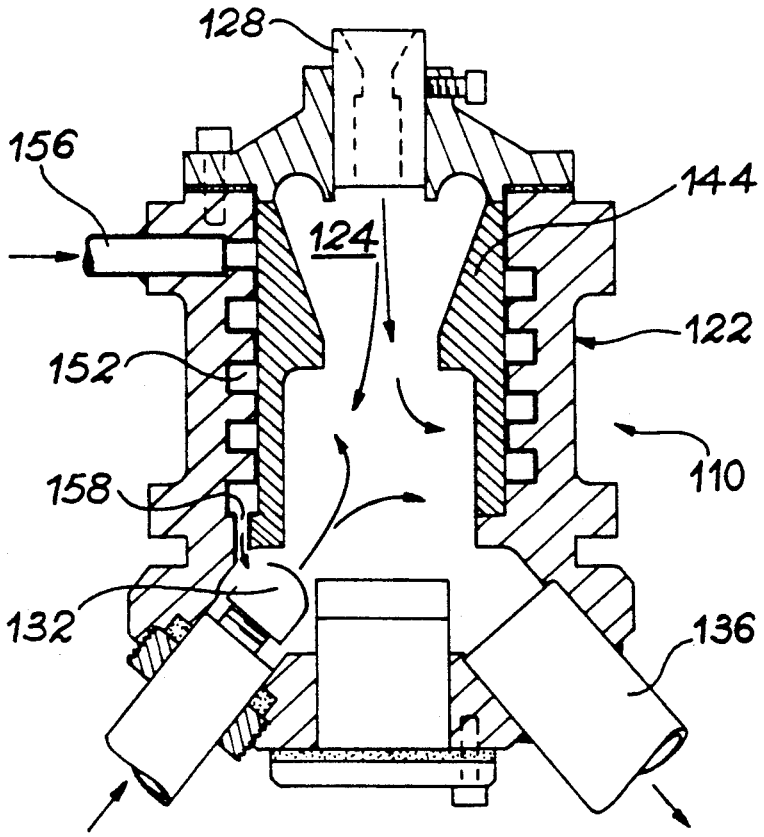
FIG. 2 is a view similar to the one on FIG. 1 and representing a second embodiment of a receptacle according to the invention in which cooling is provided by an open circuit.

FIG. 2 shows a second mode for embodiment of the receptacle of the invention. In this second embodiment, the members corresponding to those of the first embodiment are denoted by the same reference figures increased by 100.

The receptacle 110 of FIG. 2 has general characteristics identical to those of the receptacle 10 described above with reference to FIG. 1. It is mainly distinguished from the latter by the structure of the cooling means of the body 122 of this receptacle. In effect, if these cooling means also include a helical groove 152 formed in the body 122 around the axis of the latter and interiorly delimited by the sheathing 144, the extremity of the groove 152 closest to the nozzles 132 opens directly inside the chamber 124 via a passage 158. In this case, the cooling liquid is introduced into the groove 152 via a pipe 156 at its extremity closest to the bush 128 and is evacuated with the other effluent via the pipe 136.

Figure 3:
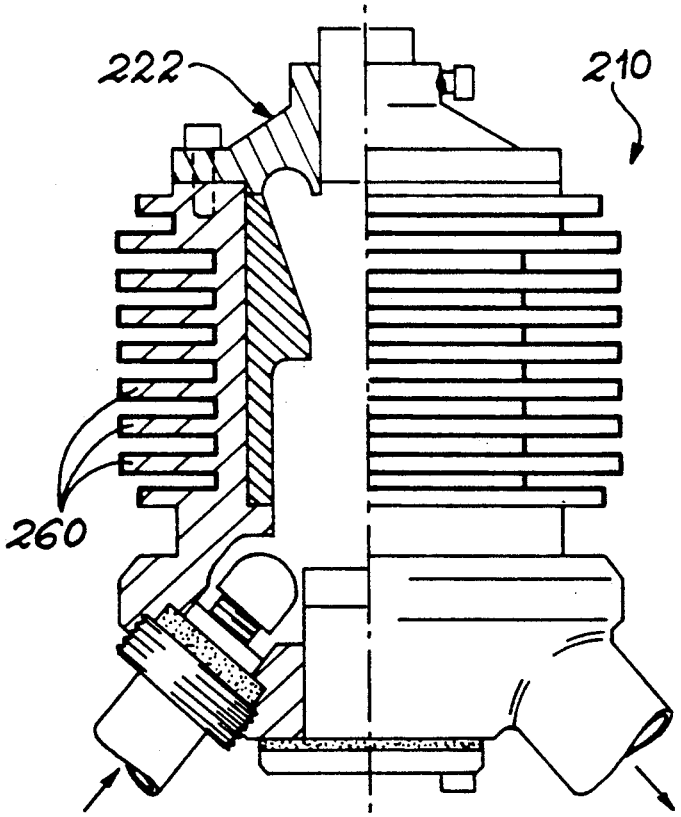
FIG. 3 is a half-sectional view similar to the view on FIG. 2 and illustrating a third embodiment of the invention in which cooling of the receptacle is obtained by means of ribs formed on the body of the receptacle.

In the embodiment shown on FIG. 3, the receptacle of the invention also has general characteristics identical to those of the receptacle described previously with reference to FIG. 1. Accordingly, the members identical to the latter are denoted by the same reference figures increased by 200.

As in the case of FIG. 2, the receptacle of FIG. 3 is mainly distinguished from that of FIG. 1 by the structure of the cooling means of the body 222 of this receptacle 210. In this case, the cooling of the body is simply ensured by providing cooling ribs 260 on the outer surface of the latter in its cylindrical part.

Regardless of the embodiment used, the destruction of the cutting jet by means of one or several counter-jets makes it possible to suppress the expendable parts or at least significantly increase their period of life. Moreover, a receptacle designed in this way may be used irrespective of the orientation of the cutting jet between vertical and horizontal. Furthermore, these described embodiments make it possible to ensure that the mist generated by the cutting and impact of the jets inside the receptacle does not reach the part to be cut.

Of course, the invention is not merely limited to the embodiments described above by way of examples, but covers all its variants.

In particular, the number of nozzles delivering the counter-jets used to destroy the cutting jet may be other than three without departing from the context of the invention. If a single nozzle is used, it is placed directly in the axis of the cutting jet, whereas when several nozzles are used, the latter are slanted with respect to this axis, as in the embodiments described. This latter situation is preferable, as it makes it possible to destroy either the cutting jet or the counter-jets by virtue of the pellet 40 and the shoulder 46 should any malfunction occur of respectively the counter-jet delivering system or the cutting jet delivering system.

What is claimed is:

1. Cutting jet receptacle for a fluid jet cutting machine and including a hollow body having one cutting jet feed orifice kept in the alignment of this jet, two nozzles delivering counter-jets inside this hollow body said counter-jets orientated in opposition with respect to the cutting jet traversing said orifice along directions inclined by a given angle with respect to one axis of the latter and distributed at regular intervals around this axis and under a certain pressure so that this counter-jet strikes the cutting jet and destroys it, and means for evacuating the fluid outside the hollow body.

2. Receptacle according to claim 1, wherein a stand-by anti-splash pellet is mounted inside the hollow body between the nozzles opposite said orifice.

3. Receptacle according to claim 1, wherein the fluid evacuation means include at least one pipe opening inside the hollow body between two nozzles along a direction inclined by approximately the same angle as said nozzles with respect to the axis of said orifice.

4. Receptacle according to claim 1, wherein the hollow body is provided with an internal sheathing comprising a stand-by shoulder placed in the prolongation of the counter-jets delivered by the nozzles.

5. Receptacle according to claim 4, wherein the internal sheathing also comprises a truncated concentration surface situated between said feed orifice and said shoulder.

6. Receptacle according to claim 1, wherein on its internal extremity surface encompassing said feed orifice, the hollow body has a recess with a semi-toric section.

7. Receptacle according to claim 1, wherein the hollow body comprises a bush or leading-in tube in which said feed orifice is formed, and means for adjusting the position of this tube along the axis of said orifice.

8. Receptacle according to claim 1 and comprising means for cooling the hollow body.

9. Receptacle according to claim 8, wherein said cooling means include a helical passage formed in the hollow body around the axis of the feed orifice, and means to cause a cooling fluid inside this passage to counter-flow with respect to the cutting jet.

10. Receptacle according to claim 8, wherein said cooling means include a helical passage formed in the hollow body around the axis of the feed orifice and opening into this body close to the evacuation means, and means to inject a cooling fluid into this passage.

11. Receptacle according to claim 8, wherein said cooling means include ribs formed on the outer surface of the hollow body.

* * * * *